US007224915B2

(12) United States Patent
Yamada et al.

(10) Patent No.: US 7,224,915 B2
(45) Date of Patent: May 29, 2007

(54) IMAGE FORMING APPARATUS AND IMAGE FORMING UNIT

(75) Inventors: Shintaro Yamada, Ibaraki (JP); Kenji Asuwa, Ibaraki (JP); Susumu Tateyama, Ibaraki (JP); Hirobumi Ooyoshi, Ibaraki (JP); Tomofumi Yoshida, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 11/367,421

(22) Filed: Mar. 6, 2006

(65) Prior Publication Data

US 2006/0198645 A1 Sep. 7, 2006

(30) Foreign Application Priority Data

Mar. 7, 2005 (JP) ..... P2005-062431

(51) Int. Cl.
*G03G 15/08* (2006.01)

(52) U.S. Cl. ..... 399/27; 399/110; 399/128; 399/177; 399/182; 399/186; 399/187

(58) Field of Classification Search ..... 399/27, 399/51, 110, 128, 177, 186, 187, 188, 189, 399/190, 191, 192
See application file for complete search history.

(56) References Cited

U.S. PATENT DOCUMENTS 6,070,032 A 5/2000 Rokutanda et al.
6,151,459 A * 11/2000 Hashimoto et al. ..... 399/27
6,212,340 B1 * 4/2001 Sugimoto et al. ..... 399/27
2002/0061196 A1 * 5/2002 Miyamoto et al. ..... 399/27
2006/0159473 A1 * 7/2006 An et al. ..... 399/27
2006/0233560 A1 * 10/2006 Harada et al. ..... 399/27
2006/0291873 A1 * 12/2006 Shishikura et al. ..... 399/13

FOREIGN PATENT DOCUMENTS

JP 5-35097 2/1993
JP 8-13719 5/1996
JP 11-344909 12/1999

OTHER PUBLICATIONS

English translation of JPO PN 2002-278395.*

* cited by examiner

*Primary Examiner*—David M. Gray
*Assistant Examiner*—Geoffrey T Evans
(74) *Attorney, Agent, or Firm*—McGinn IP Law Group, PLLC

(57) ABSTRACT

An image forming apparatus comprising: an image forming section and a residual toner amount detection unit. The image forming section includes a photosensitive member, a charging unit, an exposure unit, a developing unit, and a toner storage unit. The residual toner amount detection unit detects an amount of toner remaining in the developing unit. The residual toner amount detection unit includes a light-emitting element and a light-receiving element. After the toner is deposited on the photosensitive member to form a toner image until electric charge is given onto a photosensitive layer of the photosensitive member by the charging unit again, the light-emitting element removes electric charge remaining on the photosensitive layer.

7 Claims, 11 Drawing Sheets

IMAGE FORMING APPARATUS AND IMAGE FORMING UNIT

BACKGROUND OF THE INVENTION

1. Field of the Invention

The present invention relates to an image forming apparatus such as a copying machine, a printer, a facsimile machine, etc. for forming an image by electrophotography. Particularly, it relates to an image forming apparatus using toner for forming an image.

2. Description of the Related Art

In electrophotography, a charging unit such as a charging roller is used for giving electric charge on a photosensitive member evenly. An exposure unit is used for forming an electrostatic latent image corresponding to image data on the photosensitive member to which electric charge is given. Toner which is powder electrostatically charged in accordance with the charge pattern of the electrostatic latent image is deposited on the photosensitive member to thereby form a toner image on the electrostatic latent image. The toner image is transferred onto a recording medium such as a sheet of paper directly or through an intermediate transfer belt as an intermediate transfer member to thereby form an image.

Because electric charge remains on the photosensitive member after toner is transferred onto the recording medium, the residual electric charge is erased by an erasing unit before an image is formed again. A method of erasing electric charge by light irradiation or a method of erasing electric charge by an electrically conducting brush etc. brought into contact with the photosensitive member has been proposed as the erasing unit.

For formation of a color image, color toners such as yellow (Y), magenta (M), cyan (C), black (K), etc. are superposed on one another to form an image.

The color image forming method is roughly classified into two techniques. One is a repetitive development technique for forming a color image by repetitively developing the respective color toners on one photosensitive member. The other is a simultaneous development technique for forming a color image by simultaneously developing the respective color toners on a plurality of photosensitive members.

The repetitive development technique uses one photosensitive member for forming a color image. An intermediate transfer technique is an example of the repetitive development technique. The intermediate transfer technique is a technique in which developers that develops different color toners and a medium conveyance member are disposed around a photosensitive member so that toner images formed on the photosensitive member are color by color transferred onto the medium conveyance member successively, for example, as described in JP-A-8-137179. After this operation is repeated color by color so that the toner images of the different colors are superposed on the medium conveyance member, the superposed color toner image formed on the medium conveyance member is transferred onto a sheet of paper to thereby output a color image.

In this technique, for example, toner images of the four colors of yellow, magenta, cyan and black are color by color formed on the photosensitive member successively and then superpositively transferred onto the medium conveyance member. After all the toner images are transferred onto the medium conveyance member, the superposed color image formed on the medium conveyance member is transferred onto a medium such as a sheet of paper. Because colors are superposed successively in this manner, a time about four times as much as the printing time in the case of formation of a monochrome image from a color of black is required for forming an image.

It is however possible to reduce the number of parts because a charging unit, an exposure unit, a transfer unit, a cleaner unit and an erasing unit necessary for printing and developers corresponding to the four colors can be formed around one photosensitive member.

On the other hand, in the simultaneous development technique, photosensitive members corresponding to colors are provided as described in JP-A-5-35097. Toner images are almost simultaneously formed on the photosensitive members. The toner images are transferred in accordance with conveyance of a sheet of paper to thereby form a color image. This technique is also called "tandem electrophotographic".

In the tandem electrophotographic, image forming section each having a photosensitive member, a charging unit, an exposure unit, a developing unit and a cleaner unit are provided independently in accordance with the colors. Accordingly, when a color image is formed from toners of the four colors of yellow, magenta, cyan and black, it is necessary to provide four image forming sections.

After toner images are almost simultaneously formed by the independent image forming section corresponding to the four colors, the toner images are transferred onto an intermediate transfer medium or a medium such as a sheet of paper. Because colors are superposed simultaneously in this manner, a color image can be formed in a time approximately as much as the printing time in the case of formation of a monochrome image from a color of black. This technique is suitable for high-speed printing of a color image.

It is however necessary to increase the number of parts because all printing processes required for forming images corresponding to the colors must be prepared.

A method of detecting the amount of toner remaining in a developer has been described in JP-A-5-35097. A residual toner amount detection unit includes a toner sensor, and toner detection windows. The toner sensor is disposed in an image forming apparatus and has a light-emitting element, and a light-receiving element. The toner detection windows are provided in the developer.

When there is no toner in the developer, light emitted from the light-emitting element is transmitted through one of the toner detection windows in the developer and further transmitted through the other toner detection window on the opposite side via the inside of the developer so that the light is received by the light-receiving element.

When there is toner in the developer, light emitted from the light-emitting element is blocked by the toner in the developer so that the light cannot reach the light-receiving element on the opposite side. On this occasion, the presence of toner can be detected because the light-receiving element outputs a voltage or the like proportional to the quantity of light received by the light-receiving element.

A method of erasing residual electric charge has been described in JP-A-11-344909. In this method, a light-emitting element such as an LED lamp or a fluorescent lamp is disposed between a transfer unit and a charging unit so that electric charge remaining on a photosensitive member can be erased by application of light on the photosensitive member.

In recent years, color printers have become widespread rapidly and reduction in cost of the printers has advanced because of increasing demands for colorization of documents in offices. In addition, tandem color printers have attracted notice because of demands for increase in printing speed.

It is however difficult to reduce the size of the tandem printer because the tandem printer must have four image forming sections as descried above. The tandem printer requires a large number of parts. Accordingly, the size of the tandem printer and the cost of parts in the tandem printer must become larger than those of a printer using the repetitive development technique. Above all, the residual toner amount detection unit needs light-emitting element and light-receiving element pairs, light-emitting element drive circuits and light-receiving element receiving circuits in accordance with the four colors, so that increase in production cost is brought.

SUMMARY OF THE INVENTION

The present invention has been made in view of above circumstances and provides an image forming apparatus and an image forming unit. According to an aspect of the invention, the number of constituent parts in the image forming apparatus or the image forming unit can be reduced to thereby reduce the cost of production.

According to a first aspect of the invention, there is provided an image forming apparatus including: an image forming section and a residual toner amount detection unit. The image forming section includes a photosensitive member having a photosensitive layer in its surface; a charging unit that gives electric charge to the photosensitive member, the charging unit disposed on the photosensitive member; an exposure unit that exposes the photosensitive layer to light based on image data to form an electrostatic latent image; a developing unit that deposits toner on the electrostatic latent image formed on the photosensitive member to form a toner image; and a toner storage unit that stores toner used in the developing unit; wherein the toner image formed on the photosensitive member is transferred onto a recording medium conveyed by a medium conveyance member directly or through an intermediate transfer member to form an image. The residual toner amount detection unit detects an amount of toner remaining in the developing unit. The residual toner amount detection unit includes a light-emitting element and a light-receiving element. After the toner is deposited on the photosensitive member to form the toner image until electric charge is given onto the photosensitive layer by the charging unit again, the light-emitting element removes electric charge remaining on the photosensitive layer.

According to a second aspect of the invention, there is provided the image forming apparatus according to the first aspect, wherein at least one of the photosensitive member, the developing unit and the toner storage unit is formed as an detachable image forming unit which is detachable to a main body of the image forming apparatus; and wherein the light-emitting element is provided in the main body of the image forming apparatus. In this configuration, not only can the number of parts be reduced but also the detachable image forming unit can be repaired and exchanged easily.

According to a third aspect of the invention, there is provided the image forming apparatus according to the first aspect, wherein at least one of the photosensitive member, the developing unit and the toner storage unit is formed as an detachable unit which is detachable to a main body of the image forming apparatus; and wherein the light-emitting element is provided in the detachable unit. In this configuration, not only can the number of parts be reduced but also the optical element can be repaired and exchanged easily.

According to a fourth aspect of the invention, there is provided the image forming apparatus according to the first aspect, wherein light emitted from the light-emitting element is led to the photosensitive member through a light guide unit in order to remove electric charge remaining on the photosensitive layer. In this configuration, the light-emitting element can be arranged in an appropriate position.

According to a fifth aspect of the invention, there is provided the image forming apparatus according to the first aspect, further including: an emission amount adjusting unit that changes an amount of light emitted from the light-emitting element. In this configuration, the quantity of light emitted from the light-emitting element is reduced or emission of light is forbidden so that a good image quality can be always provided to a user.

According to a sixth aspect of the invention, there is provided an image forming unit including: a light-emitting element. The image forming unit further includes at least one of: a photosensitive member having a photosensitive layer in its surface; a developing unit that deposits toner on an electrostatic latent image formed on the photosensitive member to form a toner image; and a toner storage unit that stores toner used in the developing unit. The light-emitting element detects a residual toner amount in cooperation with a light-receiving unit of a residual toner detection unit and removes electric charge remaining on the photosensitive layer after the toner is deposited on the photosensitive member to form the toner image until electric charge is given onto the photosensitive layer by a charging unit again. In this configuration, it may be possible to provide an image forming unit in which the number of parts can be reduced.

According to a seventh aspect of the invention, there is provided the image forming unit according to the sixth aspect, wherein the image forming unit is equipped with the light-receiving element. In this configuration, it may be possible to provide an image forming unit in which not only can the number of parts be reduced but also the light-receiving element can be repaired and exchanged easily.

According to above configuration, a light-emitting element serves as the light-emitting element used in the erasing unit that erases electric charge remaining on the photosensitive member and serves also as the light-emitting element used in the residual toner amount detection unit that detects the residual amount of toner. Accordingly, the number of parts such as the light-emitting element and a drive circuit for the light-emitting element can be reduced to attain reduction in cost.

BRIEF DESCRIPTION OF THE DRAWINGS

Embodiments of the present invention will be described in detail based on the following figures, wherein.

DETAILED DESCRIPTION OF THE INVENTION

Embodiment 1

Figure 1A:
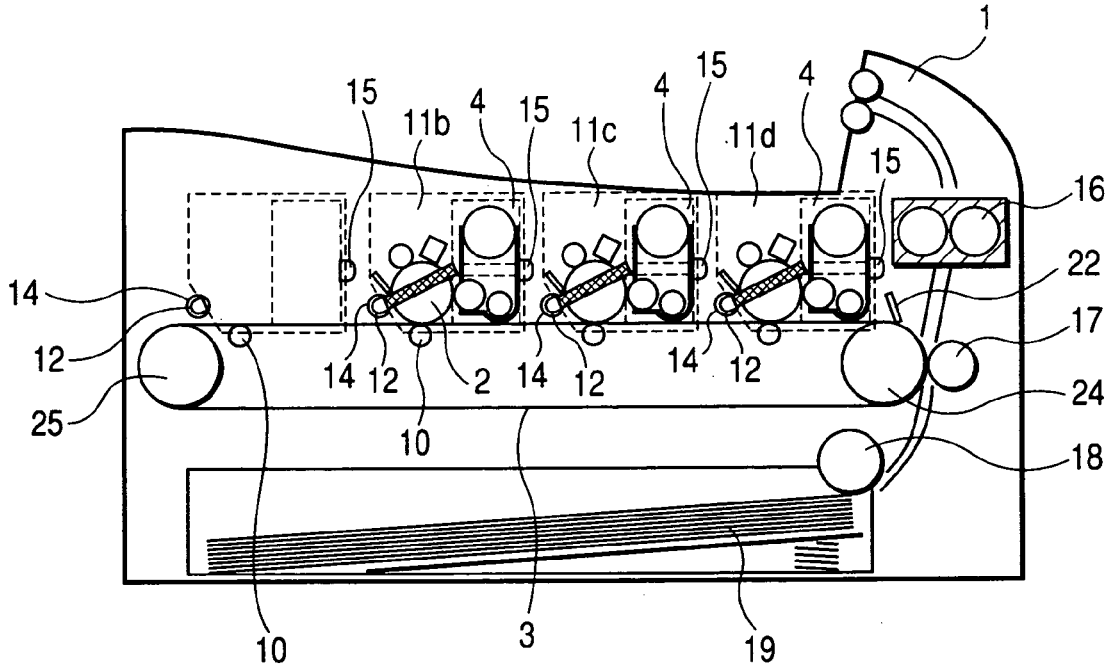
FIG. 1A is a schematic sectional view of an image forming apparatus according to Embodiment 1 of the invention.
Figure 1B:
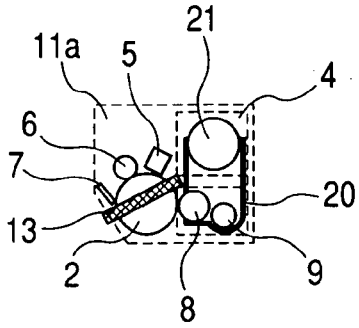
FIG. 1B is a schematic sectional view of a printing unit according to Embodiment 1.

An embodiment of an apparatus according to the invention will be described with reference to FIGS. 1A and 1B. FIG. 1A is a schematic sectional view showing the overall configuration of an image forming apparatus using printing units as image forming section. FIG. 1B is a schematic sectional view showing one of the printing units. The image forming apparatus and the printing unit will be described below.

Sheets of printing paper 19 and a pickup roller 18 for picking up the sheets of printing paper 19 are provided in a lower portion of the image forming apparatus.

As shown in FIG. 1B, each of the printing units 11*a*, 11*b*, 11*c* and 11*d* has a photosensitive member 2, a charging roller 6, an exposure device 5, and a developer 4. The photosensitive member 2 is provided as an endless cylinder having a photosensitive layer in its surface. The charging roller 6, the exposure device 5 and the developer 4 are disposed around the photosensitive member 2. The charging roller 6 gives electric charge onto the photosensitive layer of the photosensitive member 2. The exposure device 5 applies light based on image information on the electric charge given onto the photosensitive layer of the photosensitive member 2 to thereby form an electrostatic latent image. The developer 4 develops toner on the electrostatic latent image. The printing units 11*a*, 11*b*, 11*c* and 11*d*, which are units (11*a* to 11*d*) corresponding to the four colors of yellow, magenta, cyan and black necessary for forming a color image, are detachably attached to the image forming apparatus body 1 successively.

As shown in FIG. 1B, the developer 4 which is one of image forming section has a developer casing 20, a developing roller 8, a supply roller 9, and a toner vessel 21. The developing roller 8, the supply roller 9 and the toner vessel 21 are surrounded by the developer casing 20. The developing roller 8 is used for developing toner on the electrostatic latent image. The supply roller 9 is used for supplying toner to the developing roller 8. The toner used for development is stored in the toner vessel 21. Incidentally, the reference numeral 7 in FIG. 1B designates a photosensitive member cleaner.

As shown in FIG. 1A, in this embodiment, a light-emitting element 14 and a light-receiving element 15 for detecting the residual amount of toner are attached to the image forming apparatus body 1 so as to be separate from the printing units (11*a* to 11*d*).

The photosensitive members 2 of the printing units 11 abut on a medium conveyance member 3. Each transfer roller 10 is disposed so that the medium conveyance member 3 is put between the transfer roller 10 and the photosensitive member 2.

The medium conveyance member 3 is an endless belt. The medium conveyance member 3 is disposed horizontally in the apparatus body 1 in the condition that the medium conveyance member 3 is laid on a drive roller 24 and a driven roller 25 circularly. Incidentally, the positional relation between the drive roller 24 and the driven roller 25 may be reversed or two or more rollers may be provided.

In this embodiment, the image forming apparatus has printing units (11*a* to 11*d*) corresponding to the four colors of yellow, magenta, cyan and black necessary for forming a color image. The colors of yellow, magenta, cyan and black are developed in the printing units 11*a* to 11*d* respectively. Toner images thus formed are successively transferred to the medium conveyance member 3 used as an intermediate transfer belt. A second transfer roller 17 transfers the toner images onto a sheet of paper 19 fed by the pickup roller 18. Thus, an image is formed.

The sheet of paper 19 having the toner images transferred thereon is ejected after toners are fixed by a fixing device 16 under heat and pressure.

Each residual toner amount detection unit is constituted by a combination of a light-emitting element 14 such as an LED and a light-receiving element 15 such as a photo diode. Light emitted from the light-emitting element 14 passes through the developer casing 20 so as to be incident on the light-receiving element 15. When the amount of toner remaining in the developer casing 20 is small on this occasion, a large part of light emitted from the light-emitting element 14 becomes incident on the light-receiving element 15.

On the other hand, when the developer casing 20 is filled with toner, the quantity of light incident on the light-receiving element 15 is reduced. The residual amount of toner is detected on the basis of the difference between quantities of light incident on the light-receiving element 15.

Next, the erasing unit will be described. A part of light emitted from the light-emitting element 14 is led to a light guide plate 12 disposed between the transfer roller 10 and the cleaner 7, via an end portion of the photosensitive member 2 by a light guide path 13. The light emitted from the light-emitting element 14 and led to the light guide plate 12 is diffused and applied on the photosensitive member 2 to thereby erase electric charge remaining on the photosensitive member 2.

It is preferable that light emitted from the light-emitting element 14 contains the wavelength of sensitivity characteristic of the photosensitive layer on the photosensitive member 2 and the wavelength of sensitivity characteristic of the light-receiving element. When, for example, the photosensitive layer on the photosensitive member 2 has sensitivity at a wavelength of 780 nm and the light-receiving element 15 has sensitivity at a wavelength of 880 nm, light emitted from the light-emitting material 14 contains light in a range of emission wavelengths of 780 nm and 880 nm.

In this embodiment, the number of parts such as a drive circuit belonging to the light-emitting element can be reduced because the light-emitting element 14 serves as the light-emitting element of the residual toner amount detection unit and also as the light-emitting element of the erasing unit. Incidentally, the reference numeral 22 in FIG. 1A designates a belt cleaner.

Embodiment 2

Figure 2:
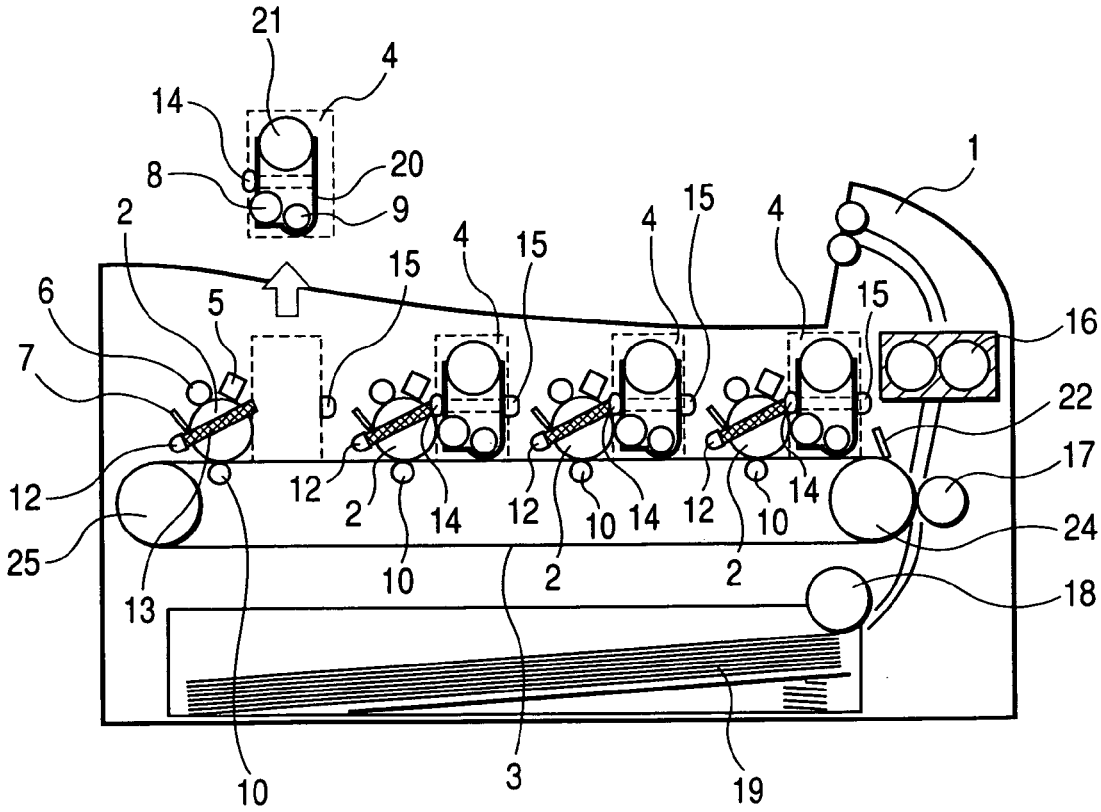
FIG. 2 is a schematic sectional view of an image forming apparatus according to Embodiment 2 of the invention.

Another embodiment of the invention will be described below with reference to FIG. 2. FIG. 2 is a sectional view showing the overall configuration of an image forming apparatus in which one 11*a* of printing units (11*a* to 11*d*) corresponding to the four colors of yellow, magenta, cyan and black necessary for forming a color image is separated.

The arrangement and functions of various kinds of parts constituting the image forming apparatus are the same as those in the image forming apparatus described above in Embodiment 1. Although Embodiment 1 shows the case where the light-emitting element 14 used in common to the residual toner amount detection unit and the erasing unit is attached to the image forming apparatus body 1, this embodiment shows the case where the light-emitting element 14 is attached to the developer 4.

For this reason, the light-emitting element 14 together with the developer 4 can be exchanged for a new one. In this configuration, not only can the number of parts shown in Embodiment 1 be reduced but also electric charge erasing failure in the erasing unit can be prevented from being caused by reduction in quantity of light due to deterioration of the light-emitting element 14 with the passage of time.

Embodiment 3

Figure 3:
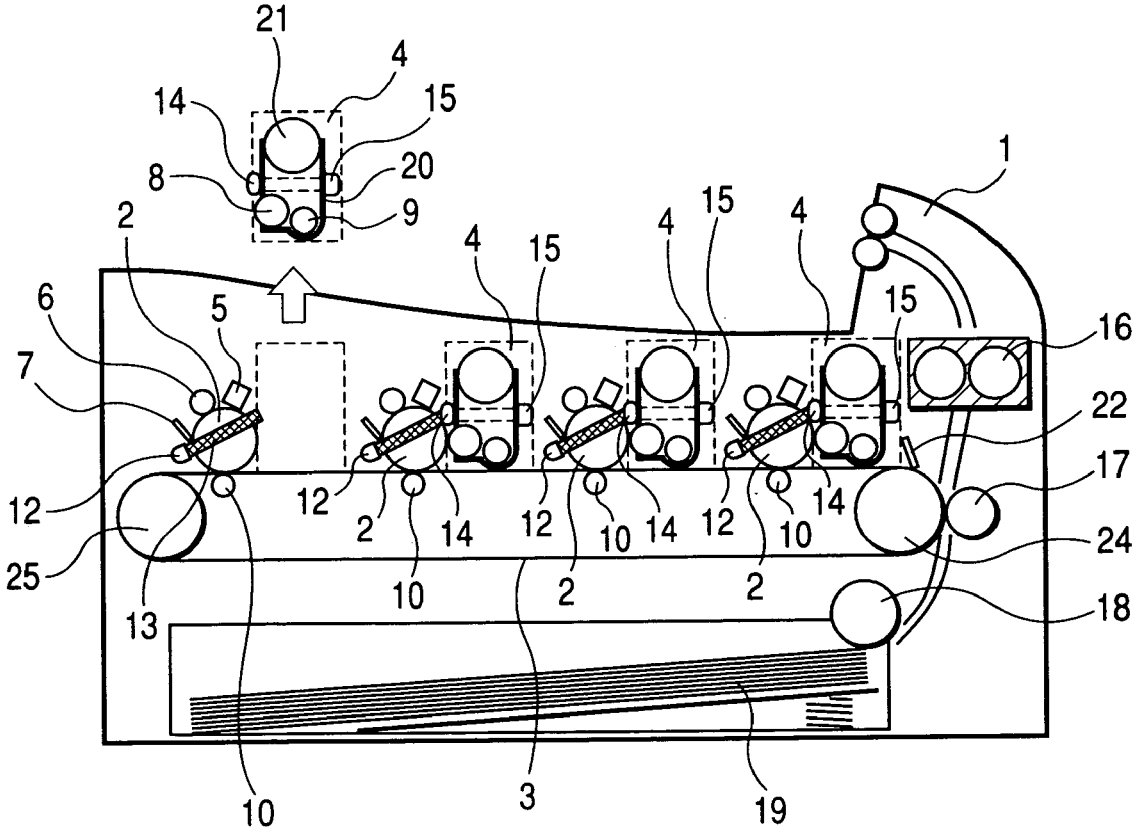
FIG. 3 is a schematic sectional view of an image forming apparatus according to Embodiment 3 of the invention.

A further embodiment of the invention will be described below with reference to FIG. 3. FIG. 3 is a sectional view showing the overall configuration of an image forming apparatus in which one 11*a* of printing units (11*a* to 11*d*) corresponding to the four colors of yellow, magenta, cyan and black necessary for forming a color image is separated.

The arrangement and functions of various kinds of parts constituting the image forming apparatus are the same as those in the image forming apparatus described above in FIGS. 1A and 1B or FIG. 2. Although Embodiment 2 shows the case where the light-receiving element 15 of the residual toner amount detection unit is attached to the image forming apparatus body 1, this embodiment shows the case where the light-receiving element 15 together with the light-emitting element 14 is attached to the developer 4.

For this reason, the light-emitting element 14 and the light-receiving element 15 together with the developer 4 can be exchanged for new ones. In this configuration, not only can the same improvement effect as in Embodiment 2 be obtained but also residual toner amount detection failure etc. can be prevented from being caused by deterioration of the light-receiving element 15 with the passage of time etc.

Embodiment 4

A further embodiment of the invention will be described below with reference to FIGS. 4 and 5.

Figure 4:
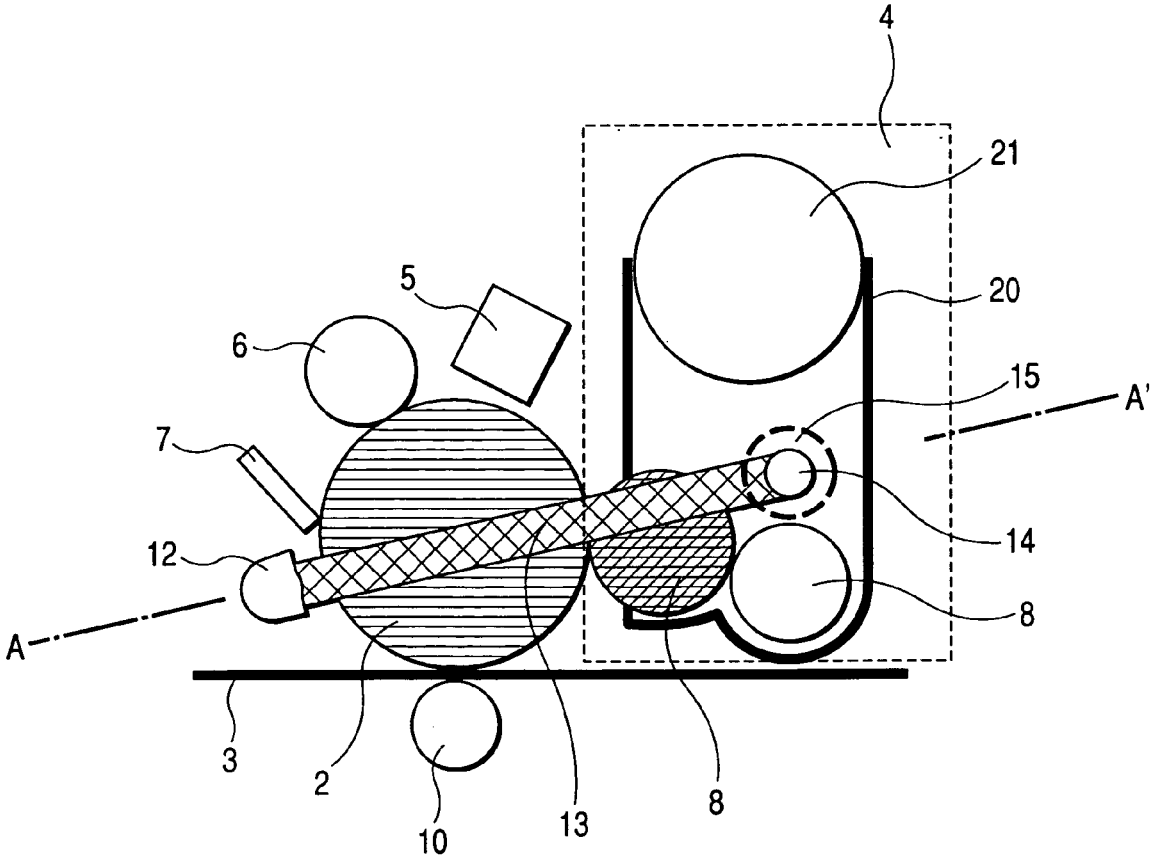
FIG. 4 is a schematic sectional view of an image forming section according to Embodiment 4 of the invention.

FIG. 4 is a view showing a state in which only the printing unit 11 described in FIG. 2 or 3 is removed. FIG. 5 is a sectional view taken along the line A–A' in FIG. 4, as seen from the upper surface.

Figure 5:
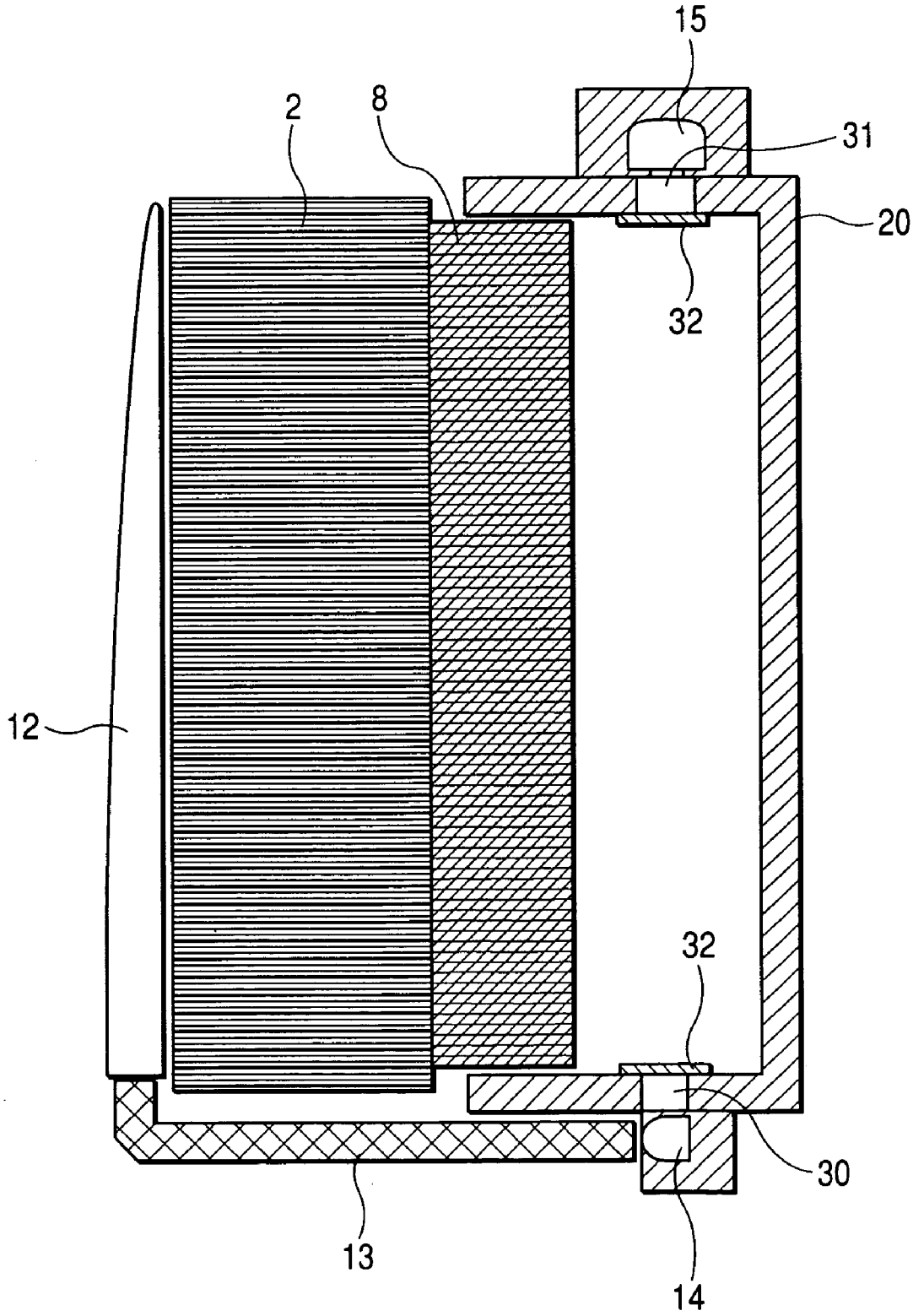
FIG. 5 is a sectional view taken along the line A–A' on the image forming section depicted in FIG. 4.

The printing unit 11 shown in FIGS. 4 and 5 operates in the same manner as in the image forming apparatus described in Embodiments 1 to 3. In this embodiment, light emitted from the light-emitting element 14 braches into an optical path for the erasing unit and an optical path for the residual toner amount detection unit, so that the light-emitting element 14 can be incorporated in the developer 4 easily.

The reference numerals 30 and 31 in FIG. 5 designate through-holes which are formed in the developer casing 20 so that light emitted from the light-emitting element 14 toward the light-receiving element 15 can be transmitted. Transparent plastic sheets 32 are stuck to inner surfaces of the though-holes 30 and 31 respectively in order to prevent toner from scattering from the casing 20.

Although this embodiment shows the case where the transparent plastic sheets 32 are used, the plastic sheets need not be provided and lenses or the like may be joined to the through-holes so that light emitted from the light-emitting element 14 can converge or diverge.

Embodiment 5

A further embodiment of the invention will be described below with reference to FIGS. 6 and 7.

Figure 6:
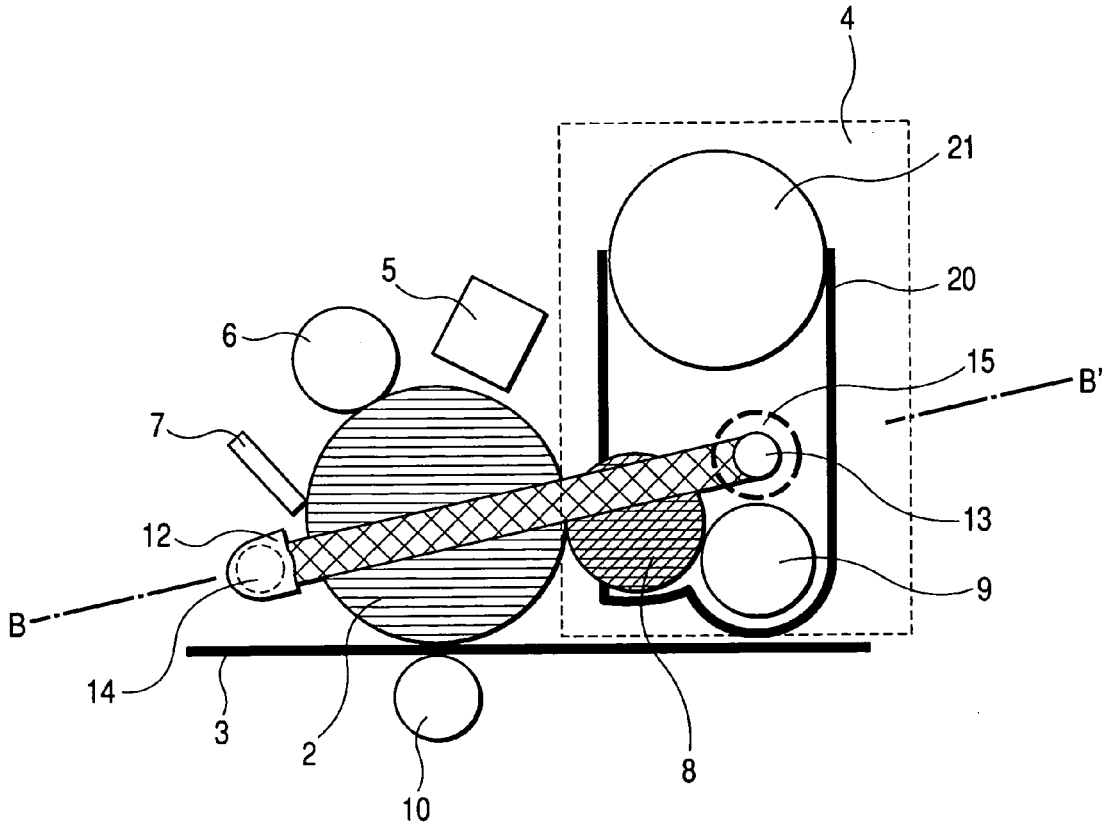
FIG. 6 is a schematic sectional view of an image forming section according to Embodiment 5 of the invention.

FIG. 6 is a view showing a state in which only the printing unit 11 described in FIG. 2 or 3 is removed. FIG. 7 is a sectional view taken along the line B–B' in FIG. 6, as seen from the upper surface.

Figure 7:
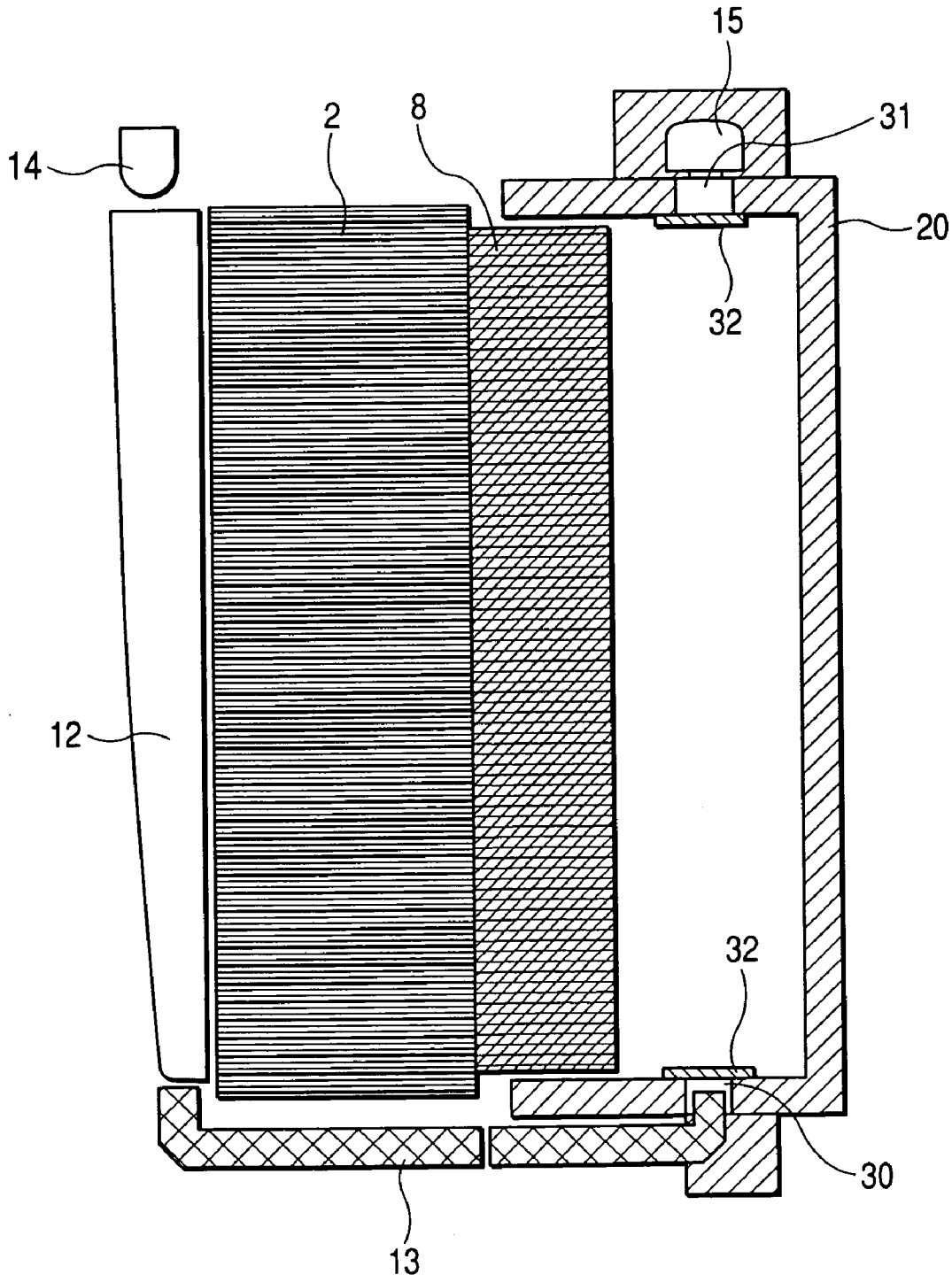
FIG. 7 is a sectional view taken along the line B–B' on the image forming section depicted in FIG. 6.

The printing unit 11 shown in FIGS. 6 and 7 operates in the same manner as in the image forming apparatus described in Embodiments 1 to 3. In this embodiment, light emitted from the light-emitting element 14 is guided by the light guide plate 12 used as an erasing unit so that a part of the emitted light is applied on the photosensitive member 2. A part of the emitted light is transmitted through the light guide path 13 as light for the residual toner amount detection unit so that the light is guided to the light-receiving element 15.

In this configuration, loss in quantity of light at the time of splitting light emitted from the light-emitting element 14 can be reduced.

The reference numeral 33 in FIG. 7 designates a through-hole which permits insertion of a front end of the light guide path 13 and through which light emitted from the front end of the light guide path 13 is applied on the light-receiving element 15.

Embodiment 6

Figure 8:
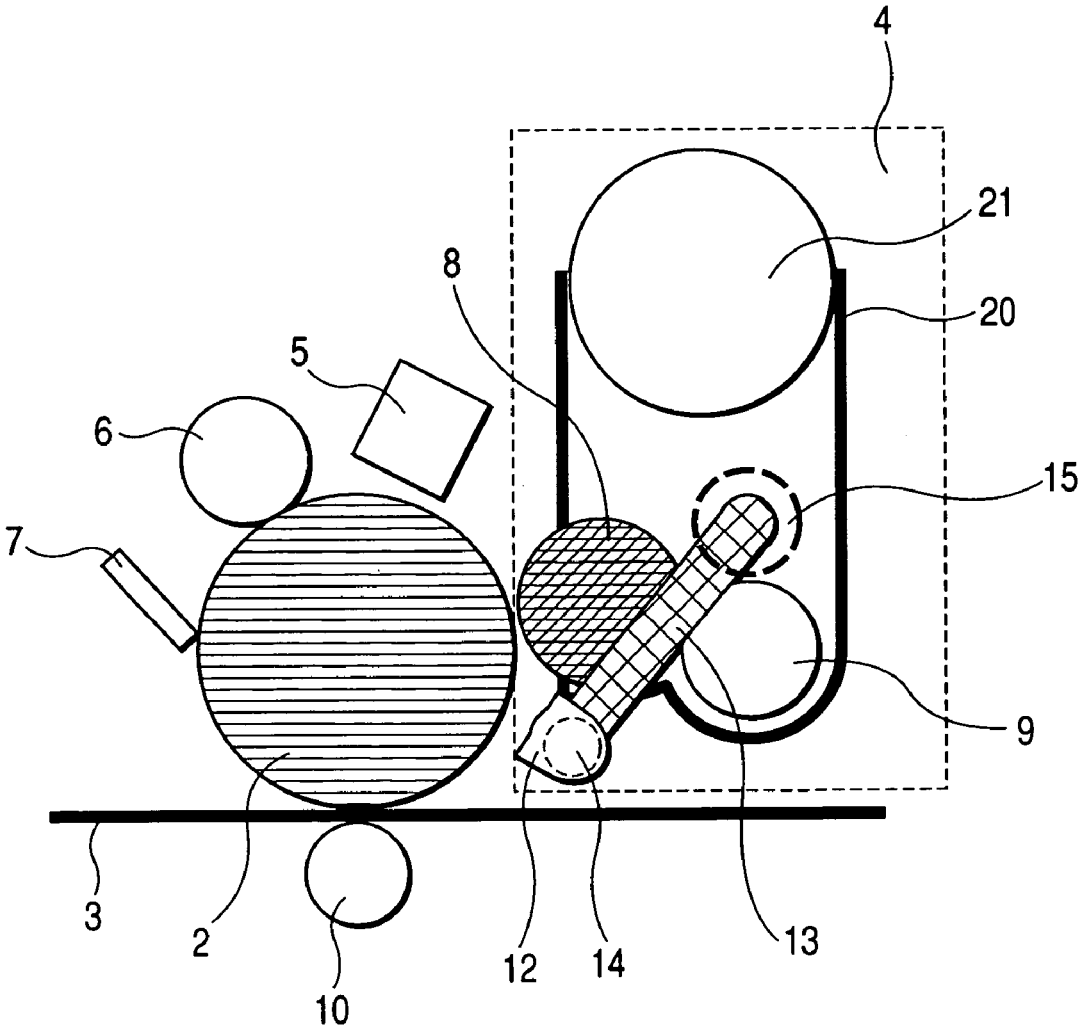
FIG. 8 is a schematic sectional view of an image forming section according to Embodiment 6 of the invention.

A further embodiment of the invention will be described below with reference to FIG. 8. FIG. 8 is a view showing a state in which only the printing unit 11 described in FIG. 2 or 3 is removed.

The printing unit 11 shown in FIG. 8 operates in the same manner as in the image forming apparatus described in Embodiments 1 to 3. In this embodiment, the light-emitting element 14 and the light guide plate 12 are disposed in a lower portion of the developer 4 so that the light-emitting element 14 and the light guide plate 12 can be incorporated in the developer 4 easily.

Embodiment 7

Figure 9:
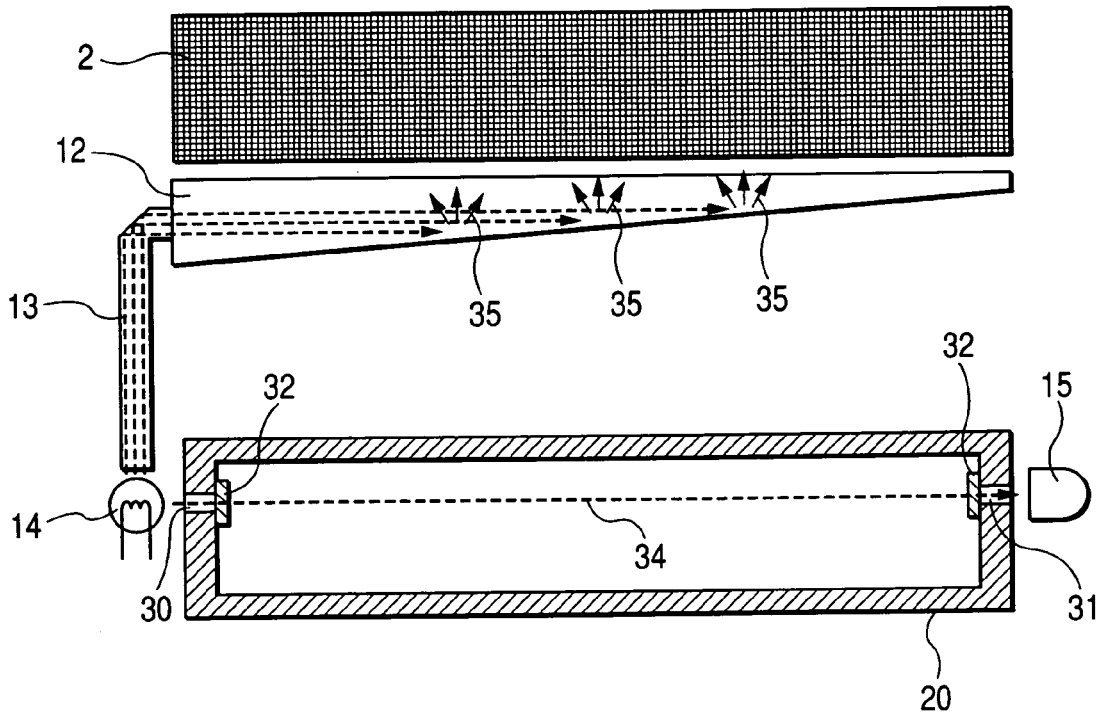
FIG. 9 is a schematic sectional view of an image forming section according to Embodiment 7 of the invention.

A further embodiment of the invention will be described below with reference to FIG. 9. FIG. 9 typically shows paths of light emitted from the light-emitting element 14.

Light emitted from the light-emitting element 14 splits into two optical paths. One is an optical path 34 which leads to the light-receiving element 15 via the developer casing 20 and which is used for the toner detection unit. The other is an optical path 35 which leads to the photosensitive member 2 after diffused by the light guide plate 12 via the light guide path 13 and which is used for the erasing unit.

The light guide path 13 is made of a transparent material such as polycarbonate, polyester, acrylic resin, glass, etc. The light guide path 13 leads light emitted from the light-emitting element 14 to the light guide plate 12. The light guide plate 12 is made of a transparent light-diffusing material such as polycarbonate, polyester, acrylic resin, glass, etc. The light guide plate 12 plays a role of reflecting/diffusing the emitted light to apply the light on the photosensitive member 2.

Embodiment 8

Figure 10:
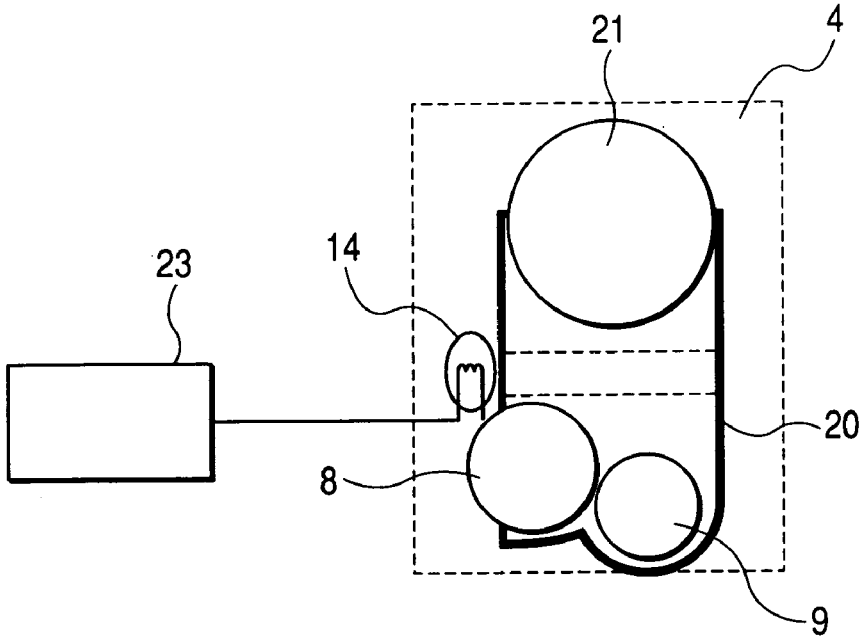
FIG. 10 is a schematic sectional view of a developer according to Embodiment 8 of the invention.

A further embodiment of the invention will be described below with reference to FIG. 10. FIG. 10 is a typical view of a controller for controlling the quantity of light emitted from the light-emitting element 14.

The developer 4 shown in FIG. 10 operates in the same manner as in the image forming apparatus described in Embodiments 1 through 3. In this embodiment, a current control circuit 23 for controlling the quantity of light emitted from the light-emitting element 14 is attached to the image forming apparatus body 1. When, for example, the developing ability of the developer 4 is lowered because of the expiration of its life, the current control circuit 23 applies an overcurrent to the light-emitting element 14 to disable the light-emitting element 14 from emitting light.

By this measure, the image forming apparatus is informed of the time of exchange of the developer 4 having the developing ability lowered, so that a good image quality can be always provided to the user.

Embodiment 9

Figure 11:
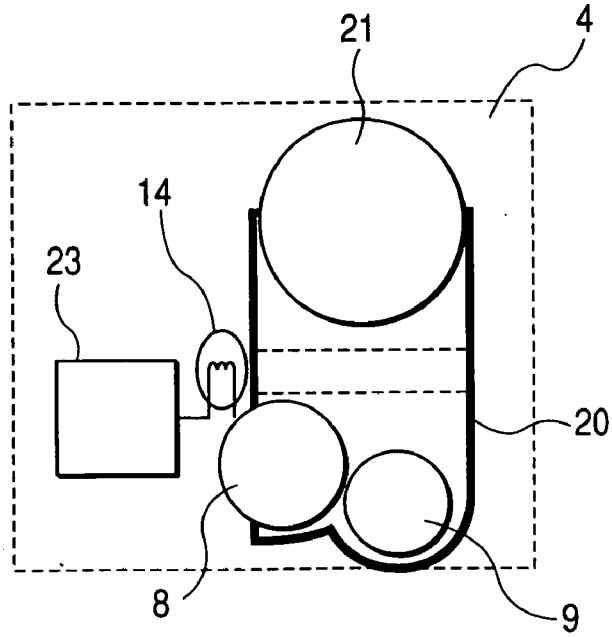
FIG. 11 is a schematic sectional view of a developer according to Embodiment 9 of the invention.

A further embodiment of the invention will be described below with reference to FIG. 11. FIG. 11 is a typical view of a controller for controlling the quantity of light emitted from the light-emitting element 14. The developer 4 shown in FIG. 11 operates in the same manner as in the image forming apparatus described in Embodiments 1 through 3.

In this embodiment, a current control circuit 23 for controlling the quantity of light emitted from the light-emitting element 14 is attached to the developer 4. When, for example, the developing ability of the developer 4 is lowered because of the expiration of its life, the current control circuit 23 controls the current applied to the light-emitting element 14 so that the quantity of light emitted from the light-emitting element 14 can be reduced or light emission can be forbidden.

By this measure, the light-emitting element 14 can be recycled while the same effect as in Embodiment 8 can be obtained.

Embodiment 10

Figure 12:
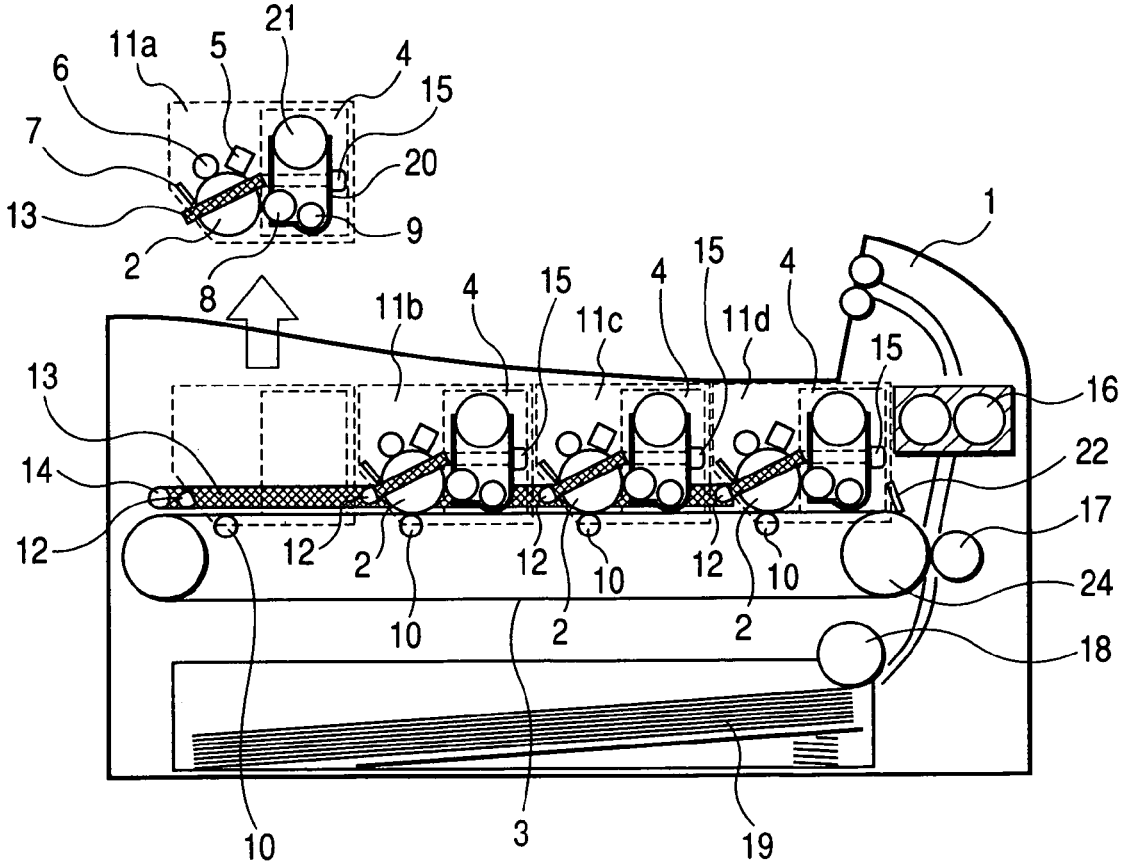
FIG. 12 is a schematic sectional view of an image forming apparatus according to Embodiment 10 of the invention.

A further embodiment of the invention will be described below with reference to FIG. 12. FIG. 12 is a sectional view showing the overall configuration of a printing unit and an image forming apparatus using the printing units.

The arrangement and functions of various parts constituting the image forming apparatus are the same as those of the image forming apparatus described in Embodiment 1. Although Embodiment 1 shows the case where the light-emitting element 14 used in common to the residual toner amount detection unit and the erasing unit is provided for each of the printing units (11*a* to 11*d*) of the four colors of yellow, magenta, cyan and black, this embodiment shows the case where the light guide path 13 is used so that one light-emitting element 14 can be used for all the printing units.

For this reason, the number of parts belonging to the light-emitting element 14 can be reduced compared with the image forming apparatus described in Embodiment 1.

Although each of the embodiments of the invention exemplifies the image forming apparatus using the medium conveyance member 3 as an intermediate transfer medium, the medium conveyance member 3 may be constituted by a paper conveyance member or the like.

Although each of the embodiments of the invention exemplifies the image forming apparatus provided with the printing units 11 disposed horizontally, the printing units 11 may be disposed vertically or obliquely.

Although each of the printing units 11 has been described on the case where a roller coated with an elastic material is used as the charging roller 6, a brush roller coated with a brush or a non-contact charger may be used as the charging roller 6.

For example, a device which is an array of LEDs arranged in one row in the widthwise direction of the photosensitive member and which has 600 to 1200 light-emitting diodes arranged per 1 inch (25.4 mm) so that each diode can be turned on and off at predetermined timing may be used as the exposure device 5. As another example, a device constituted by a combination of a laser and a rotary mirror or an exposure device constituted by a combination of a light-emitting device and an optical switch such as a micro-mirror may be used.

Although each of the embodiments of the invention shows the case where the light-emitting element 14 as the erasing unit applies light on the photosensitive member 2 through the light guide plate 12, light may be applied on the photosensitive member 2 directly without interposition of the light guide plate 12 or the light-emitting element 14 may apply light on the light-receiving element 15 without use of the light guide path 13.

The case where the light-emitting element 14 is formed to apply light on the photosensitive member 2 or the light-receiving element 15 through the light guide unit such as the light guide plate 12, the light guide path, etc. as shown in each of the embodiments of the invention is however preferred because not only a small light-emitting element 14 can be used but also there is room for arrangement of other units.

Although each of the embodiments of the invention shows the case where a sheet of paper which is a paper member is used as the printing medium used in the image forming apparatus, a plastic material such as a plastic sheet may be used as the printing medium.

Although each of the embodiments of the invention shows the case where printing units (11*a* to 11*d*) corresponding to the four colors of yellow, magenta, cyan and black necessary for forming a color image are used as the printing units, one printing unit corresponding to only a color of black may be used or a repetitive development technique using four rotations may be used.

Although each of the embodiments of the invention shows the case where printing units (11*a* to 11*d*) each having all of the photosensitive member 2, the developing unit 4 and the toner storage unit 21 (Embodiments 1 and 10) or printing units (11*a* to 11*d*) each having the developing unit 4 and the toner storage unit 21 (Embodiments 2 to 9) are used as the printing units (11*a* to 11*d*) which are image forming sections, the invention is not limited thereto. For example, at least one of the photosensitive member 2, the developing unit 4 and the toner storage unit may be used as a unit which can be separated from the apparatus body 1.

The image forming apparatus according to the invention can be applied not only to the color printer shown in the aforementioned embodiments but also to a copying machine, a printer, a facsimile machine, etc. for forming an image by electrophotography.

The entire disclosure of Japanese Patent Application No. 2005-062431 filed on Mar. 7, 2005 including specification, claims, drawings and abstract is incorporated herein be reference in its entirety.

What is claimed is:

1. An image forming apparatus comprising:

an image forming section including:

a photosensitive member having a photosensitive layer in its surface;

a charging unit that gives electric charge to the photosensitive member, the charging unit disposed on the photosensitive member;

an exposure unit that exposes the photosensitive layer to light based on image data to form an electrostatic latent image;

a developing unit that deposits toner on the electrostatic latent image formed on the photosensitive member to form a toner image; and a toner storage unit that stores toner used in the developing unit;

wherein the toner image formed on the photosensitive member is transferred onto a recording medium conveyed by a medium conveyance member directly or through an intermediate transfer member to form an image; and a residual toner amount detection unit that detects an amount of toner remaining in the developing unit, the residual toner amount detection unit including a light-emitting element and a light-receiving element;

wherein after the toner is deposited on the photosensitive member to form the toner image until electric charge is given onto the photosensitive layer by the charging unit again, the light-emitting element removes electric charge remaining on the photosensitive layer.

2. The image forming apparatus according to claim 1, wherein at least one of the photosensitive member, the developing unit and the toner storage unit is formed as a detachable image forming unit which is attachable to a main body of the image forming apparatus; and wherein the light-emitting element is provided in the main body of the image forming apparatus.

3. The image forming apparatus according to claim 1, wherein at least one of the photosensitive member, the developing unit and the toner storage unit is formed as a detachable unit which is attachable to a main body of the image forming apparatus; and wherein the light-emitting element is provided in the detachable unit.

4. The image forming apparatus according to claim 1, wherein light emitted from the light-emitting element is led to the photosensitive member through a light guide unit in order to remove electric charge remaining on the photosensitive layer.

5. The image forming apparatus according to claim 1, further comprising:

an emission amount adjusting unit that changes an amount of light emitted from the light-emitting element.

6. An image forming unit comprising:

a light-emitting element;

wherein the image forming unit further comprises at least one of:

a photosensitive member having a photosensitive layer in its surface;

a developing unit that deposits toner on an electrostatic latent image formed on the photosensitive member to form a toner image; and a toner storage unit that stores toner used in the developing unit; and wherein the light-emitting element detects a residual toner amount in cooperation with a light-receiving unit of a residual toner detection unit and removes electric charge remaining on the photosensitive layer after the toner is deposited on the photosensitive member to form the toner image until electric charge is given onto the photosensitive layer by a charging unit again.

7. The image forming unit according to claim 6, wherein the image forming unit is equipped with the light-receiving element.

* * * * *